US006182907B1

(12) United States Patent
Nakagawa et al.

(10) Patent No.: US 6,182,907 B1
(45) Date of Patent: Feb. 6, 2001

(54) LIQUID JET DRIVING DEVICE AND LIQUID JET DRIVING METHOD

(75) Inventors: Hiroyuki Nakagawa; Hiroshi Fukumoto; Jyunichi Aizawa; Yasuhiko Ozaki, all of Tokyo (JP)

(73) Assignee: Mitsubishi Denki Kabushiki Kaisha, Tokyo (JP)

( * ) Notice: Under 35 U.S.C. 154(b), the term of this patent shall be extended for 0 days.

(21) Appl. No.: 09/358,420

(22) Filed: Jul. 22, 1999

(30) Foreign Application Priority Data

Dec. 18, 1998 (JP) ..... 10-361107

(51) Int. Cl.[7] ..... B05B 1/08; B05B 3/04; B41J 2/17

(52) U.S. Cl. ..... 239/102.2; 347/94

(58) Field of Search ..... 239/102.1, 102.2; 347/68–72, 94

(56) References Cited

U.S. PATENT DOCUMENTS 3,765,606 * 10/1973 Moss et al. ..... 239/102
4,196,437 * 4/1980 Hertz ..... 346/1.1
4,667,877 * 5/1987 Yao et al. ..... 239/102.2
5,988,799 * 11/1999 Abe et al. ..... 347/68
6,045,208 * 4/2000 Hirahara et al. ..... 347/68

FOREIGN PATENT DOCUMENTS 2-303849 12/1990 (JP) .
9-57963 3/1997 (JP) .

* cited by examiner

*Primary Examiner*—James Hook
*Assistant Examiner*—Davis Hwu
(74) *Attorney, Agent, or Firm*—Oblon, Spivak, McClelland, Maier & Neustadt, P.C.

(57) ABSTRACT

At a dot cycle (T3), a dummy burst signal as well as a jet burst signal are supplied for a vibration exciter to drive it so that the vibration exciter can provide liquid with a periodic radiation pressure. The dummy burst signal is so determined as to jet no droplet, with a smaller number of pulses and so on. That allows a stable motion of meniscus of ink and it is thereby possible to stably jet the droplets. With this control provided is a technique to improve a shape of an ink surface from which the droplets are created and stably jet the droplets when a liquid jet unit for jetting the droplets from a liquid surface is driven.

20 Claims, 15 Drawing Sheets

FIG. 3A BASIC SIGNAL

FIG. 3B JET BURST SIGNAL TRAINS

FIG. 3C DOT RECORDING SIGNAL TRAINS

T2
T1(=k·T0)
T0
1 2 3 ... k
JET BURST SIGNAL
0
Ps
ρcu
SOUND PRESSURE
−ρcu
Bi
T0/2
ρu²
BASE RADIATION PRESSURE
Pi
ρu²/2
RADIATION PRESSURE
TIME

FIG. 15A
FIG. 15B
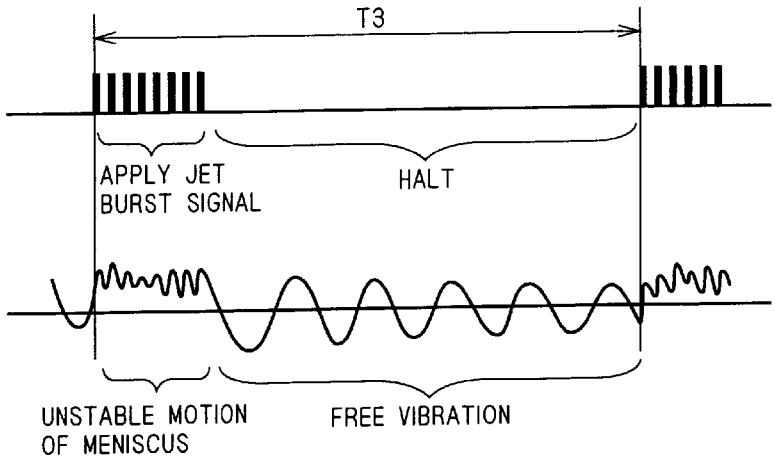
FIG. 16A
FIG. 16B
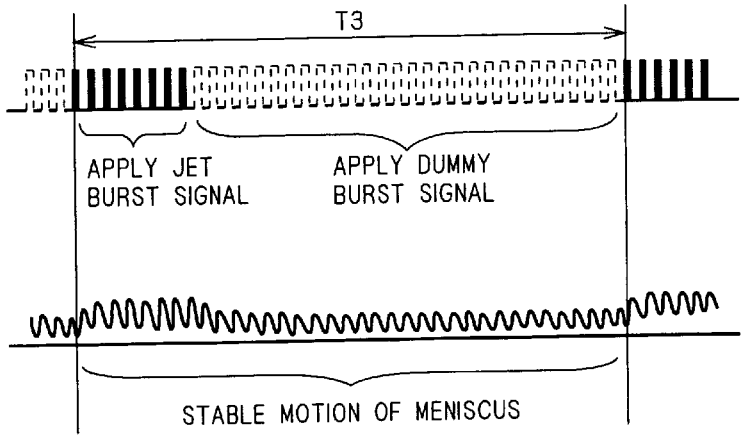

FIG. 17A
FIG. 17B
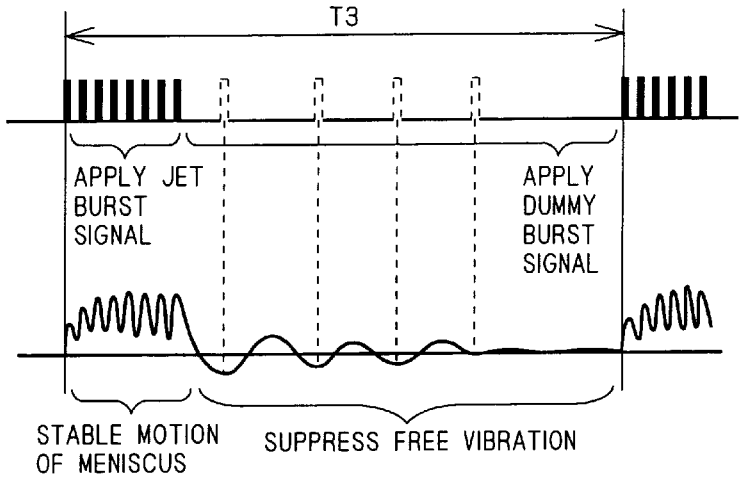
FIG. 18
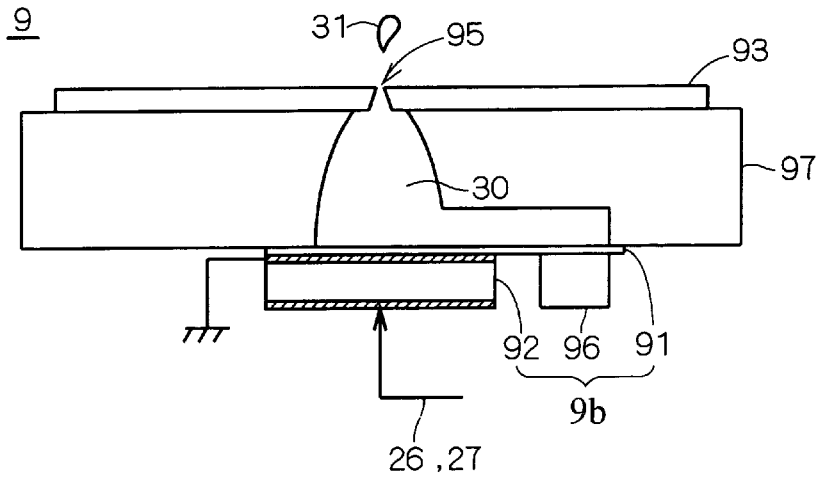

FIG. 19A
FIG. 19B
FIG. 19C
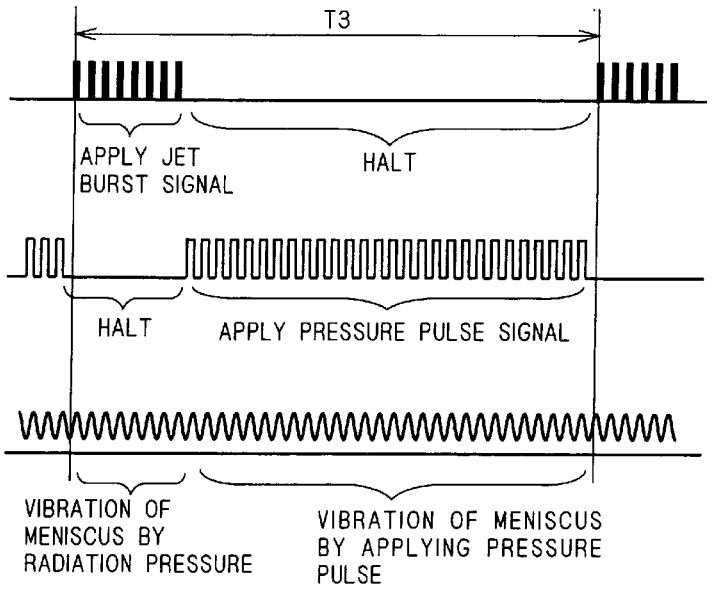
FIG. 20A
FIG. 20B
FIG. 20C
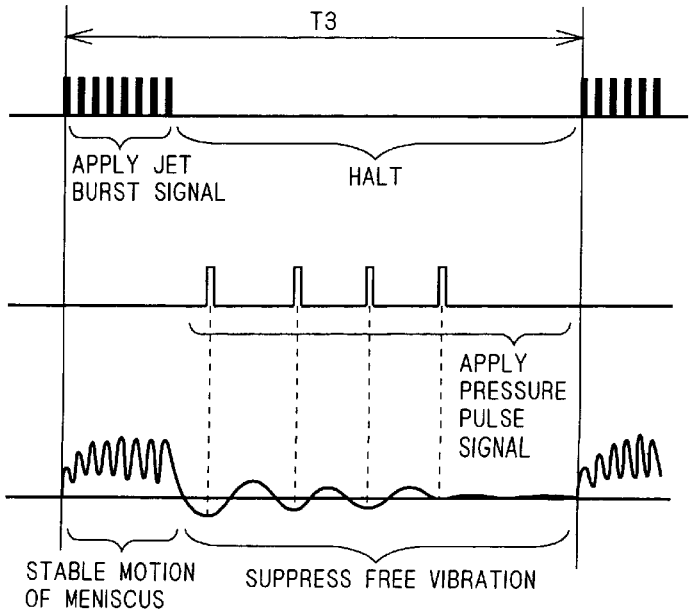

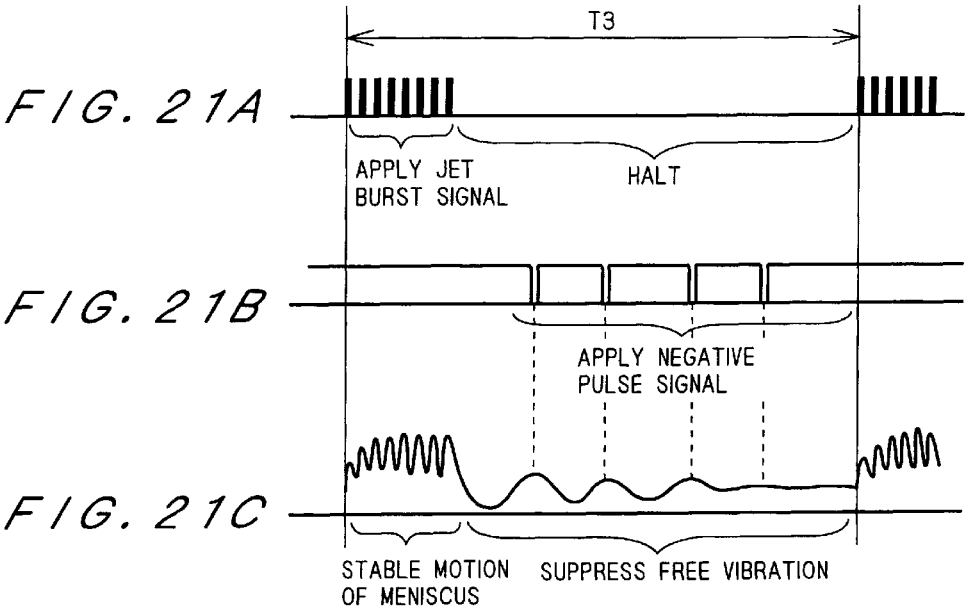
T3
FIG. 21A
APPLY JET
BURST SIGNAL
HALT
FIG. 21B
APPLY NEGATIVE
PULSE SIGNAL
FIG. 21C
STABLE MOTION
OF MENISCUS
SUPPRESS FREE VIBRATION
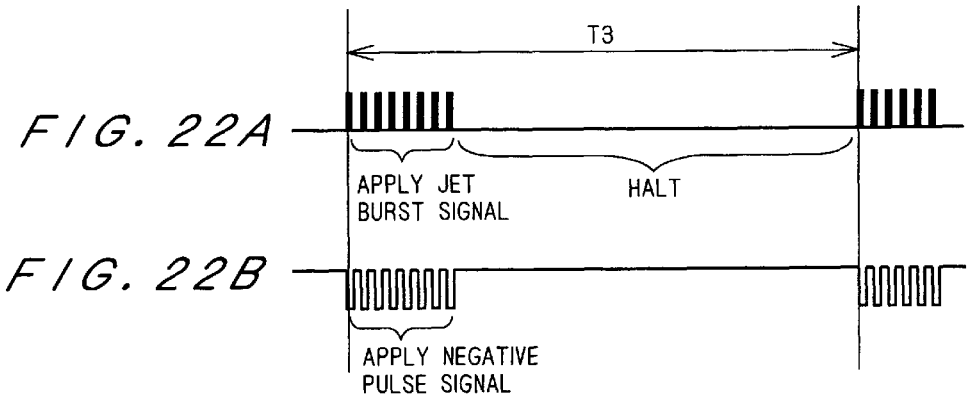
T3
FIG. 22A
APPLY JET
BURST SIGNAL
HALT
FIG. 22B
APPLY NEGATIVE
PULSE SIGNAL

LIQUID JET DRIVING DEVICE AND LIQUID JET DRIVING METHOD

BACKGROUND OF THE INVENTION

1. Field of the Invention

The present invention relates to a technique to drive a liquid jet unit for jetting droplets from a liquid surface, and more particularly to a technique to jet droplets by providing vibration to a liquid having a surface limitedly exposed by an opening.

2. Description of the Background Art

There has been a technique of depositing ink onto printing paper in a form of droplet to draw images and characters, i.e., ink jet printing. In this description, for distinction, a term "jet" is used when a plurality of ink droplets are simultaneously generated and a term "discharge" is used when droplets are sequentially generated one by one.

To faithfully reproduce tone of an image proposed is a technique of ultrasonically providing ink with vibration to obtain droplets from an ink surface. For example, Japanese Patent Application Laid Open Gazette No. 2-303849 discloses a technique of controlling the length of period for continuously providing ink with ultrasound to control the amount of ink to be discharged. Japanese Patent Application Laid Open Gazette No. 10-128968 discloses a technique of providing ink with ultrasonic burst including a certain number of pulses repeatedly a plurality of times to control the amount of ink to be jetted with the repeat number.

In the technique of controlling the length of period for continuously providing ink with ultrasound to control the amount of ink to be discharged, however, in order to discharge a large amount of ink, it is necessary to provide ink with continuous ultrasonic supply for a long time. That causes a marked rise of the level of ink surface from the opening with a radiation pressure as discussed later, resulting in an unstable discharge of droplets.

The technique of providing ink with ultrasonic burst repeatedly a plurality of times is superior in not providing continuous radiation pressure. Since the ink jet printing, however, requires depositing of ink on printing paper with different tones for dots, it is necessary to adjust the timing of sending the printing paper and that of disposing ink for every dot. The length of period while no continuous ultrasonic is supplied varies from dot to dot in the technique of providing ink with ultrasonic burst repeatedly a plurality of times as well as in the technique of controlling the length of period for continuously providing ink with ultrasound. Since the length of period while a radiation pressure is provided therefore varies from dot to dot, the rise of ink level from the opening varies from dot to dot. This variation causes an unstable jetting of droplets, and further causes deterioration in graininess in terms of printing quality and difficulty in controlling gradation.

SUMMARY OF THE INVENTION

The present invention is directed to a liquid jet driving device. According to a first aspect of the present invention, the liquid jet driving device comprises: a liquid jet unit having a jet surface provided with an opening to limitedly expose a surface of liquid to be jetted out and a vibration exciter provided on an opposite side to the jet surface with the liquid interposed therebetween for providing the liquid with vibration; and a driving unit for providing the vibration exciter with a suppressing signal and a jet burst signal consisting of a pulse train of a first frequency to drive the vibration exciter. In the device of the first aspect, vibration provided for the liquid by the vibration exciter which is driven with the jet burst signal is sufficient for the liquid to jet out from the jet surface and vibration provided for the liquid by the vibration exciter which is driven with the suppressing signal is not sufficient for the liquid to jet out from the jet surface.

According to a second aspect of the present invention, in the liquid jet driving device according to the first aspect, the suppressing signal is a suppressing burst signal consisting of a pulse train of the first frequency and has less pulses in number than the jet burst signal.

According to a third aspect of the present invention, in the liquid jet driving device according to the first aspect, the suppressing signal is a suppressing burst signal consisting of a pulse train of the first frequency which has a smaller amplitude than those of the jet burst signal.

According to a fourth aspect of the present invention, in the liquid jet driving device according to the first aspect, the vibration exciter is driven with the jet burst signal to provide the liquid with a first radiation pressure, the liquid makes free vibration caused by the first radiation pressure in a mode specific to the shape of the opening, the suppressing signal is supplied for the vibration exciter near at least one timing when the free vibration takes an amplitude of extreme value, and the vibration exciter is driven with the suppressing signal to provide the liquid with a second radiation pressure which works in a direction to suppress the free vibration.

According to a fifth aspect of the present invention, in the liquid jet driving device according to the first aspect, the vibration exciter has a first vibration exciter supplied with the jet burst signal and a second vibration exciter supplied with the sup pressing signal.

According to a sixth aspect of the present invention, in the liquid jet driving device according to the fifth aspect, the first vibration exciter is driven with the jet burst signal to provide the liquid with a radiation pressure, the liquid makes free vibration caused by the radiation pressure in a mode specific to the shape and size of the opening, the suppressing signal is supplied for the second vibration exciter near at least one timing when the free vibration takes an amplitude of extreme value, and the second vibration exciter is driven with the suppressing signal to provide the liquid with a pressure which works in a direction to suppress the free vibration.

According to a seventh aspect of the present invention, in the liquid jet driving device according to the sixth aspect, the suppressing signal is supplied for the vibration exciter at the point of time when a liquid level of the liquid in the opening takes an extreme value near the side of the vibration exciter in the free vibration.

According to an eighth aspect of the present invention, in the liquid jet driving device according to the fifth aspect, the second vibration exciter is driven with the suppressing signal in a period while the jet burst signal is supplied for the first vibration exciter, to provide the liquid with a pressure having a direction opposite to that of a radiation pressure provided for the liquid by the first vibration exciter driven with the jet burst signal.

According to a ninth aspect of the present invention, in the liquid jet driving device according to the first aspect, the jet burst signal and the suppressing signal are supplied for the vibration exciter repeatedly with a second frequency.

According to a tenth aspect of the present invention, in the liquid jet driving device according to the ninth aspect, the second frequency is a frequency with which the liquid makes free vibration in a mode specific to the shape of the opening.

According to an eleventh aspect of the present invention, in the liquid jet driving device according to the first aspect, the jet burst signal is supplied for the vibration exciter repeatedly during a period required for a to-and-fro movement of a surface wave in the opening, which is excited on the basis of a radiation pressure to push the liquid out from the opening in a period while the vibration exciter is driven.

According to a twelfth aspect of the present invention, the liquid jet driving device comprises: a liquid jet unit having a jet surface provided with an opening to limitedly expose a surface of liquid to be jetted out and a vibration exciter provided on an opposite side to the jet surface with the liquid interposed therebetween for providing the liquid with vibration; a driving unit for providing the vibration exciter with a jet burst signal consisting of a pulse train of a predetermined frequency to drive the vibration exciter; and a hydrostatic pressure applying mechanism for applying a controllable hydrostatic pressure to the liquid.

The present invention is also directed to a method of driving liquid jet. According to a thirteenth aspect of the present invention, the method of driving liquid jet, for driving a liquid jet unit having a jet surface provided with an opening to limitedly expose a surface of liquid to be jetted out and a vibration exciter provided on an opposite side to the jet surface with the liquid interposed therebetween for providing the liquid with vibration, the method comprises the steps of: supplying the vibration exciter with a jet burst signal consisting of a pulse train of a first frequency so that the vibration exciter provides the liquid with vibration sufficient to jet out from the jet surface, to drive the vibration exciter; and supplying the vibration exciter with a suppressing signal which makes the vibration exciter provide the liquid with vibration not sufficient to jet out from the jet surface.

According to a fourteenth aspect of the present invention, in the method of driving liquid jet according to the thirteenth aspect, the suppressing signal is a suppressing burst signal consisting of a pulse train of the first frequency.

According to a fifteenth aspect of the present invention, in the method of driving liquid jet according to the thirteenth aspect, the suppressing signal is a pulse to be supplied in order for the vibration exciter to provide the liquid with a pressure.

According to a sixteenth aspect of the present invention, in the method of driving liquid jet according to the thirteenth aspect, the suppressing signal is supplied for the vibration exciter repeatedly with a second frequency together with the jet burst signal.

According to a seventeenth aspect of the present invention, in the method of driving liquid jet according to the thirteenth aspect, against free vibration in a mode specific to the shape of the opening, which is made by the liquid on the basis of a radiation pressure to push the liquid out from the opening in a period while the jet burst signal is supplied, the suppressing signal drives the vibration exciter in a direction to suppress the free vibration near at least one timing when the free vibration takes an amplitude of extreme value.

According to an eighteenth aspect of the present invention, in the method of driving liquid jet according to the thirteenth aspect, the suppressing signal is supplied for the vibration exciter in a period while the jet burst signal is supplied and provides the liquid with a pressure having a direction opposite to that of a radiation pressure to push the liquid out from the opening in a period while the jet burst signal is supplied.

According to a nineteenth aspect of the present invention, the method of driving liquid jet, for driving a liquid jet unit having a jet surface provided with an opening to limitedly expose a surface of liquid to be jetted out and a vibration exciter provided on an opposite side to the jet surface with the liquid interposed therebetween for providing the liquid with vibration, the method comprises the steps of: supplying the vibration exciter with a jet burst signal consisting of a pulse train of a predetermined frequency which makes the vibration exciter provide the liquid with vibration sufficient to jet out from the jet surface, to drive the vibration exciter; and applying a positive hydrostatic pressure to said liquid in a waiting state where said liquid is in a stationary state as said jet burst signal is not supplied and reducing said positive hydrostatic pressure or applying a negative hydrostatic pressure after said jet burst signal is supplied.

In the liquid jet driving device of the first aspect and the methods of driving liquid jet of the thirteenth and fifteenth aspects, the jet burst signal is supplied for the vibration exciter to create the fine first surface wave at an end portion of the opening and the liquid is jetted out as droplets from near the top of the first surface wave. At this time, the vibration provided for the liquid by the vibration exciter on the basis of the jet burst signal also works as the radiation pressure to push the liquid out from the opening in the period while the vibration exciter is driven. The second surface wave excited depending on whether there is the radiation pressure or not moves in the opening also after the first surface wave is attenuated. Since the radiation pressure on the basis of the suppressing signal is provided for the liquid, however, by supplying the vibration exciter with the suppressing signal, the free vibration of the liquid in a mode specific to the shape and size of the opening is suppressed. That suppresses variation in shape of the liquid surface in the opening, to ensure easy control of liquid jet after that.

In the devices of the second and third aspects and the method of the fourteenth aspect, since the suppressing burst signal having the first frequency can be generated by controlling the number of pulses and the amplitude of the pulse train, the vibration exciter has only to create great resonance near the first frequency. That allows a simple structure of the vibration exciter.

In the device s of the fourth, sixth and seventh aspects and the method of the seventeenth aspect, since a pressure is provided for the liquid so as to suppress the free vibration whose wavelength is longer than the vibration of the liquid on the basis of the jet burst signal near at its extreme value of amplitude, a smaller number of suppressing signals are supplied.

In the device of the fifth aspect, since the second vibration exciter is driven with the suppressing signal, the first vibration exciter can be designed most suitably to the first frequency, to effectively create the first surface wave.

In the device of the eighth aspect, the vibration provided for the liquid by the first vibration exciter on the basis of the jet burst signal also works as the radiation pressure to push the liquid out from the opening in a period while the first vibration exciter is driven. Since the second vibration exciter, however, provides the liquid with a pressure opposite to the radiation pressure in the period the radiation pressure works, the device of the eighth aspect can produce the same effect as the device of the first aspect.

In the device of the ninth aspect and the method of the sixteenth aspect, since the suppressing signal is supplied at the same cycle as the jet burst signal, the motion of liquid becomes stationary and stable droplets are jetted. By using the second frequency set to be larger than the period while the jet burst signal is supplied, the meniscus of liquid in the opening is retreated towards the side of the vibration exciter, to narrow the width of jetting liquid.

In the device of the tenth aspect, since the shape of meniscus can be largely displaced by utilizing the second surface wave, it is possible to jet large droplets suitable for an image having a small number of tones.

In the device of the eleventh aspect, by adjusting the cycle of the state of meniscus of the second surface wave to supply of the jet burst signal, the state of meniscus in supplying the jet burst signal can be kept equally.

In the device of the twelfth aspect, with the hydrostatic pressure applying mechanism, by applying the hydrostatic pressure to the liquid so that the meniscus of the liquid reaches the rim of the opening in a waiting state where the liquid is in a stationary state as the jet burst signal is not supplied and reducing the hydrostatic pressure or applying the negative pressure when the jet burst signal is supplied, it is possible to prevent the meniscus from spilling over from the opening. That makes the meniscus stable, and avoids jet failure of the liquid and jetting of large droplets.

In the method of the eighteenth aspect, the vibration provided for the liquid on the basis of the jet burst signal also works as the radiation pressure to push the liquid out from the opening in the period. Since the pressure opposite to the radiation pressure is provided for the liquid in the period while the radiation pressure works, the method of the eighteenth aspect can produce the same effect as the method of the thirteenth aspect.

In the method of the nineteenth aspect since the pressure to raise the liquid level is provided in the waiting period and the pressure is reduced after the jet burst signal is supplied, the meniscus becomes stable and it is possible to avoid the jet failure and jetting of large droplets.

An object of the present invention is to provide a technique for stable jetting of droplets by improving the shape of ink surface from which the droplets are generated. A particular object, noticing a radiation pressure, is to provide a technique of controlling variation of liquid level due to the radiation pressure from dot to dot.

These and other objects, features, aspects and advantages of the present invention will become more apparent from the following detailed description of the present invention when taken in conjunction with the accompanying drawings.

BRIEF DESCRIPTION OF THE DRAWINGS

FIGS. 15A and 15B are waveform views showing a relation between the jet burst signal and meniscus motion of ink;

FIGS. 16A and 16B are waveform views showing a liquid jet driving technique in accordance with a first preferred embodiment of the present invention;

FIGS. 17A and 17B are waveform views showing a liquid jet driving technique in accordance with a second preferred embodiment of the present invention;

FIG. 18 is a cross section schematically showing a structure in accordance with third to sixth preferred embodiments of the present invention;

FIGS. 19A to 19C are waveform views showing a liquid jet driving technique in accordance with the third preferred embodiment of the present invention;

FIGS. 20A to 20C are waveform views showing a liquid jet driving technique in accordance with the fourth preferred embodiment of the present invention;

FIGS. 21A to 21C are waveform views showing a liquid jet driving technique in accordance with the fifth preferred embodiment of the present invention;

FIGS. 22A and 22B are waveform views showing a liquid jet driving technique in accordance with the sixth preferred embodiment of the present invention;

DESCRIPTION OF THE PREFERRED EMBODIMENTS

A. Background of The Invention

Figure 1:
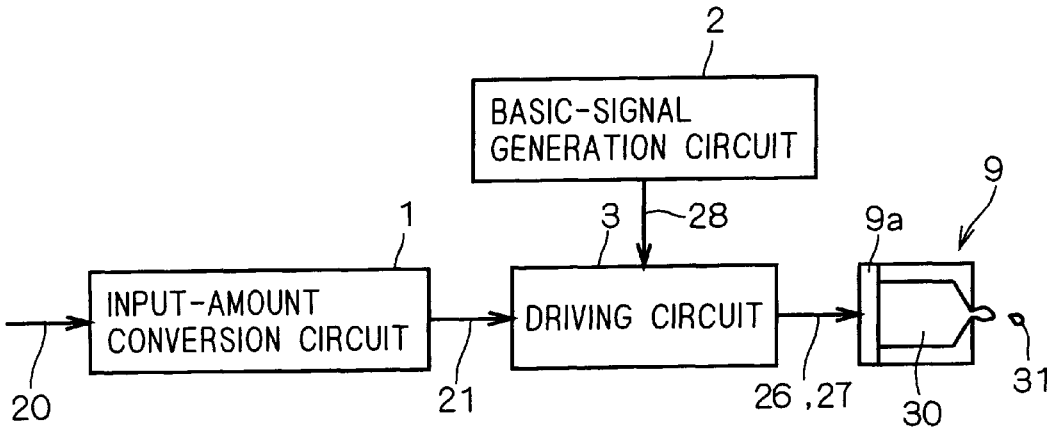
FIG. 1 is a block diagram showing a configuration of a liquid jet driving device which is also applied to the present invention.

Before detailed discussion on preferred embodiments of the present invention, findings on a radiation pressure as the background of the present invention will be discussed. FIG. 1 is a block diagram showing a configuration of a liquid jet driving device which is also applied to the present invention. The liquid jet driving device comprises an input-amount conversion circuit 1 for converting an image signal 20 having information on, for example, a tone value of an image to be drawn, into a jet signal 21, a basic-signal generation circuit 2 for generating a basic signal 28 consisting of continuous pulses of frequency f0, a driving circuit 3 adopting the basic signal 28 for a predetermined period based on the jet signal 21 to generate a jet burst signal 26 consisting of continuous pulses of frequency f0 in number k and an ink head 9 including a vibration exciter 9*a* driven with the jet burst signal 26. The ink head 9 has ink 30 therein. The vibration exciter 9*a* is driven with the jet burst signal 26 to jet the ink 30 as a droplet 31 from the ink head 9.

The input-amount conversion circuit 1 performs conversion in consideration of conversion of dynamic range (e.g., converting tone values of 256 levels into 32 bits) and a non-linear relation between the amount of ink to be jetted from the ink head 9 and the repeat number of jet burst signal 26.

Further, in the preferred embodiments discussed later, the driving circuit 3 generates a suppressing signal 27 and the vibration exciter 9*a* is also driven with the suppressing signal 27.

Figure 2:
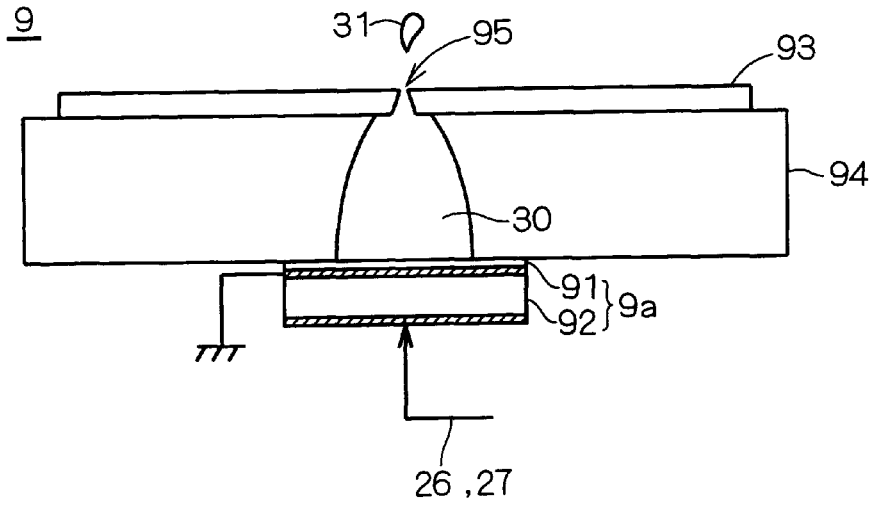
FIG. 2 is a cross section schematically showing a structure of an ink head.

FIG. 2 is a cross section schematically showing a structure of the ink head 9. The ink head 9 comprises a body 94 having, for example, rotary paraboloid as an inner wall to store the ink 30, a nozzle plate 93 having an opening 95 to limitedly expose a surface of the ink 30 and being communicated with the body 94 through the opening 95 and the vibration exciter 9*a* for providing ink 30 with vibration. Without the nozzle plate 93, the opening 95 may be disposed in the body 94.

The vibration exciter 9*a* has an ultrasonic vibration exciter, for example, a piezoelectric vibrator 92, and further a protection sheet 91 between the body 94 and the piezoelectric vibrator 92, for protecting the piezoelectric vibrator 92 so that it should not be wetted by the ink 30.

(A-1) Description on Jet Burst Signal

FIGS. 3A to 3C are waveform views of the basic signal 28, the jet burst signal 26 and a dot recording signal, respectively, which show a relation among the three signals. The basic signal 28 has a cycle T0=1/f0, assuming herein that, for example, f0=10 MHz (T0=100 ns). Each jet burst signal 26 is generated by collecting k pulses of the basic signals 28. It this case, k=6.

The jet burst signal 26 is repeated a predetermined number of times every predetermined burst cycle T2. The jet burst signal 26 is repeated burst number dj of times at the j-th dot #j, depending on a value of the jet signal 21 corresponding to a tone value required of one dot. A period corresponding to one dot is defined as a dot cycle T3, and for example, it is shown that burst numbers d1=25, d2=5 and d3=17 at the first dot #1, the second dot #2 and the third dot #3, respectively. Since T3-dj·T2 varies from dot to dot, an unstable level of ink surface is caused as above discussed.

(A-2) Description on Emission Pressure

Figure 4:
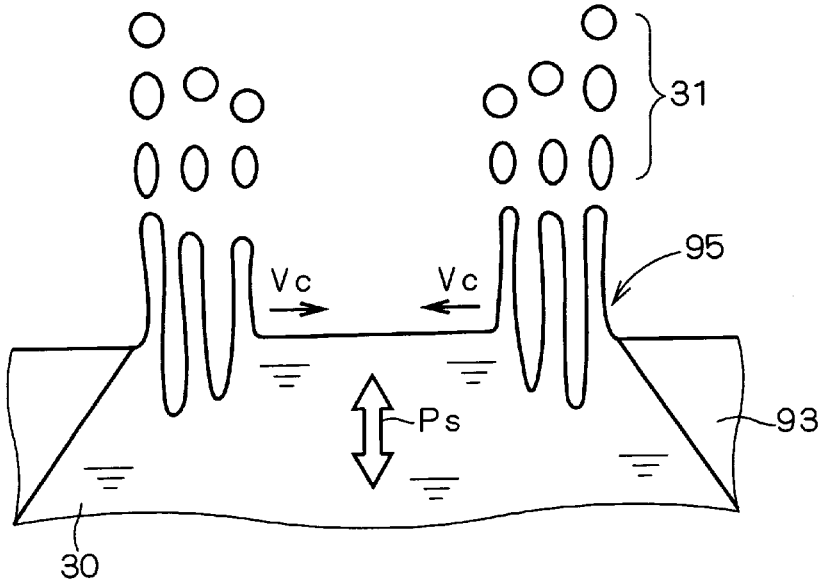
FIG. 4 is a cross section schematically showing a concept of a sound pressure.
Figure 5:
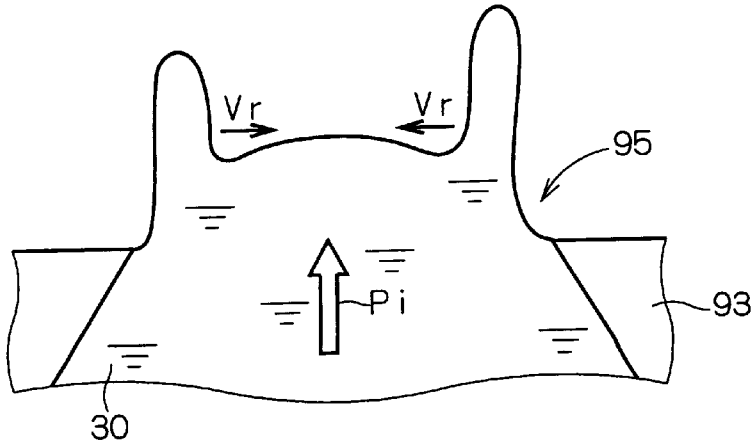
FIG. 5 is a cross section schematically showing a concept of a radiation pressure.
Figures 6A, 6B, 6C, 6D:
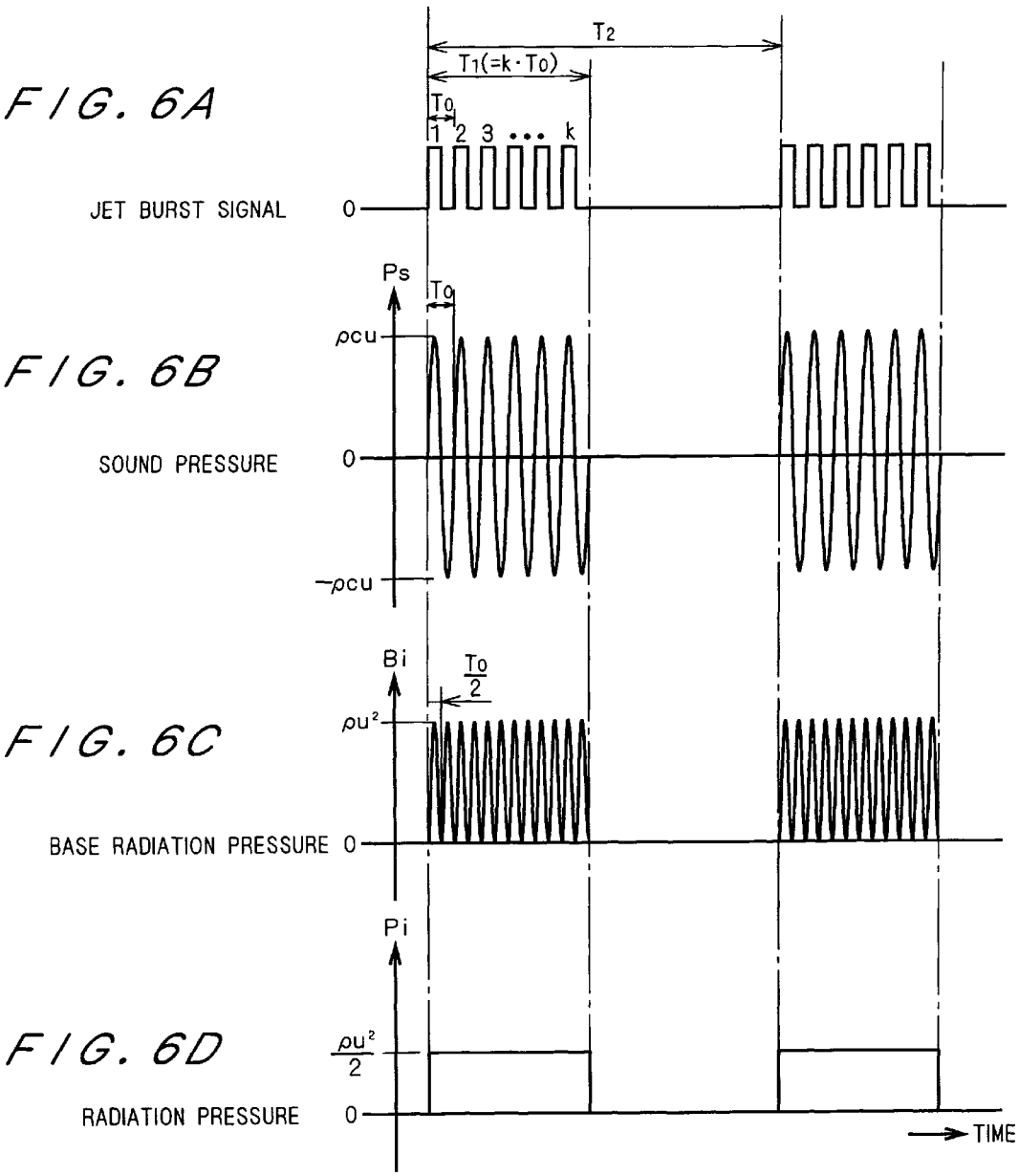
FIGS. 6A to 6D are waveform views showing a relation among the jet burst signal, the sound pressure and the radiation pressure.

FIGS. 4 and 5 are cross sections schematically showing concepts of a sound pressure Ps a radiation pressure Pi. Though a discussion will be made taking a case where the piezoelectric vibrator 92 makes thickness longitudinal vibration as an example, these two pressures may be applied to the ink 30 even by other-mode vibration.

When the piezoelectric vibrator 92 provides the ink 30 with vibration with a frequency of f0, the sound pressure Ps having a frequency f0 drives the surface of the ink 30 exposed in the opening 95 almost vertically in two direction, as shown in FIG. 4. Since a rim of the opening 95 serves as a fixed end of the surface of the ink 30, a first surface wave is created from the rim of the opening 95. The first surface wave jets the fine droplet 31 from its loop. The first surface wave goes towards the center of the opening 95 at a velocity Vc, and is attenuated to vanish immediately after vibration excitement of the piezoelectric vibrator 92 is completed.

On the other hand, since the ink 30 has an interface with air near the opening 95 and the vibration of the ink 30 is entirely reflected on the interface, the radiation pressure Pi drives the surface of the ink 30 almost vertically as shown in FIG. 5 in one direction from the piezoelectric vibrator 92 to the opening 95. Since the radiation pressure Pi vanishes after vibration excitement of the piezoelectric vibrator 92 is completed, a second surface wave is created from the rim of the opening 95. The second surface wave goes towards the center of the opening 95 at a velocity Vr.

FIGS. 6A to 6D are waveform views showing a relation among the jet burst signal 26, the sound pressure Ps and the radiation pressure Pi. The pulse train included in the jet burst signal 26 has a cycle T0=1/f0 and each jet burst signal 26 consists of pulses in a burst in number k. The burst cycle T2 is set at not less than k·T0, and therefore there is a relation of T2-k·T0≧0 between adjacent jet bust signals 26.

Figure 3:
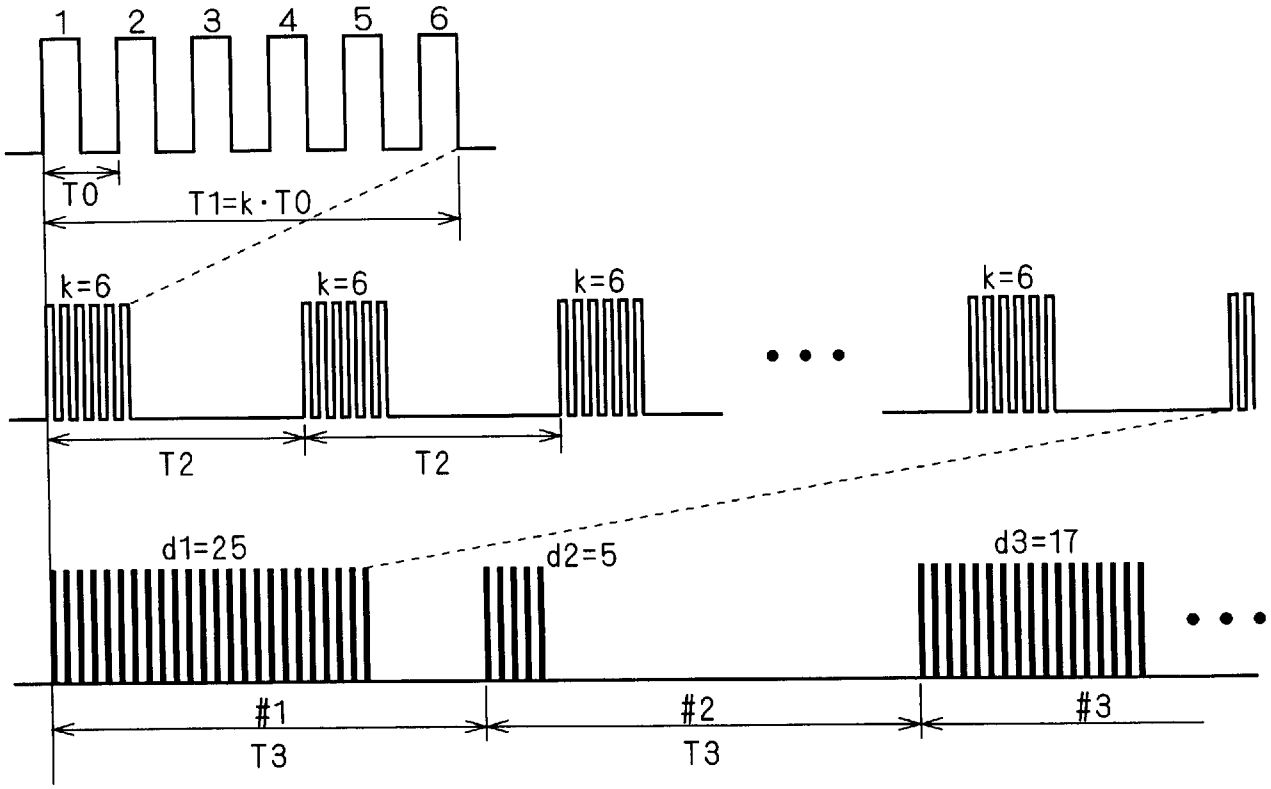
FIGS. 3A to 3C are waveform views for description of a jet burst signal.

The piezoelectric vibrator 92 has a shape of thin plate perpendicular to a direction from the vibration exciter 9*a* to the opening 95 as shown in FIG. 3, and receives the jet burst signal 26 to excite thickness longitudinal vibration almost in a form of sine wave. If it is now considered that the ink 30 has viscosity low enough to ideally follow the vibration applied by the piezoelectric vibrator 92, assuming that the velocity of sound propagated in the ink 30 (sound velocity), the maximum value of the velocity of the ink moving by vibration excitement (maximum velocity) and the density of the ink 30 are c, u and ρ, respectively, the sound pressure Ps has a cycle T0 and shows a sine wave with an amplitude ρcu. When a pressure in a case of no vibration excitement for the ink 30 is 0, the sound pressure Ps varies within a range of ±ρcu and drives the ink 30 in the two directions as shown in FIG. 4. It is assumed herein that a positive sign is taken in a direction from the piezoelectric vibrator 92 to the opening 95.

On the other hand, the vibration of the ink 30 is entirely reflected on the interface with air near the opening 95, and that causes a base radiation pressure Bi showing a sine wave with a cycle T0/2 and an amplitude $\rho u^2/2$. The base radiation pressure Bi varies from 0 to $\rho u^2$. The maximum velocity u of the ink 30 is lower than the sound velocity c, and therefore the amplitude of the base radiation pressure Bi produces little effect on the motion of the ink when the sound pressure Ps is applied to the ink 30. The base radiation pressure Bi, however, has an average value $\rho u^2/2$ in a period T1 while the jet burst signal 26 exists. Since the radiation pressure Pi, as a pulse having the average value, is applied in one direction, when the vibration excitement continues to perform on the ink 30 for a long time, the meniscus of the ink 30 in the opening 95 greatly rises.

Further, when the sound pressure Ps is not applied between the adjacent jet burst signals 26, the base radiation pressure Bi also vanishes. Therefore, the radiation pressure Pi produces a considerable effect, i.e., the second surface wave on the ink 30 entirely at the dot cycle T3.

Further, Japanese Patent Application Laid Open Gazette No. 9-57963 discloses an aspect where the piezoelectric vibrator is driven with triangular waveform and surface waves going from the rim to the center of the opening interfere with one another to discharge a droplet and another aspect where a plurality of fine droplets are jetted from an end of the surface wave. In both aspects, however, the triangular wave has to make a great drive on the liquid and is not a technique in consideration of radiation pressure accompanying the jet burst signal like the present invention.

(A-3) Correction of Burst Cycle

In a state where the jet burst signal 26 is repeatedly supplied, i.e., the period dj·T2 in the dot cycle T3 of the j-th dot #j referring to FIG. 3C, the burst cycle T2 is corrected on the basis of the velocity Vr of the second surface wave, to keep the state of the meniscus of the ink 30 in a common shape at the point of time when the jet burst signal 26 is supplied. This correction of the burst cycle is adopted in the preferred embodiments discussed later as the present invention.

FIGS. 7 to 14 are cross sections schematically showing states of meniscus of the ink 30 in the opening 95 at time t=0 μs, 0.6 μs, 1 μs, 2 μs, 4 μs, 8 μs, 10 μs and 15.6 μs , respectively, assuming that the sound pressure Ps of f0=10 MHz and k=6 begins to be supplied at the time t=0 μs.

Figure 7:
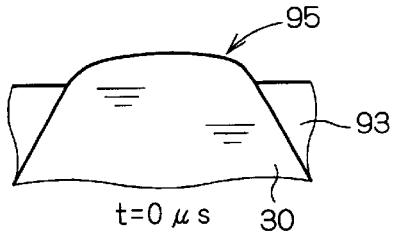
FIGS. 7 to 14 are cross sections schematically showing states of meniscus of ink in an opening.
Figure 8:
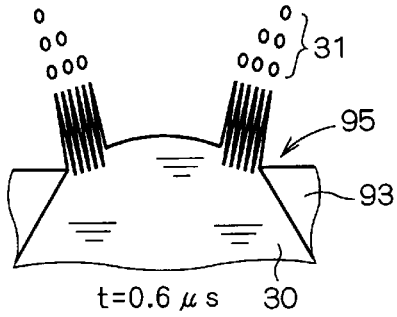
Figure 9:
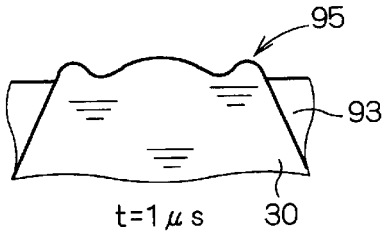
Figure 10:
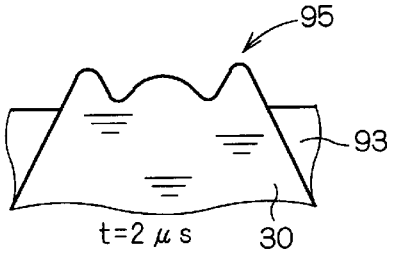
Figure 11:
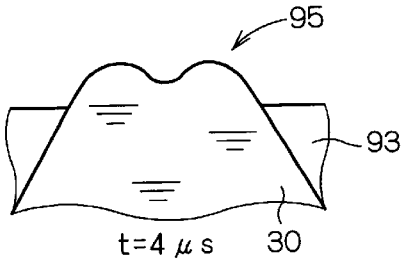
Figure 12:
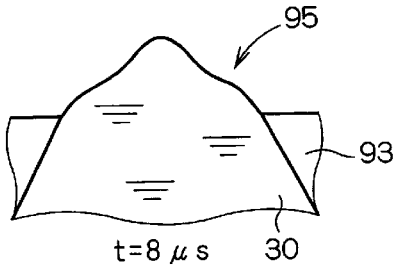
Figure 13:
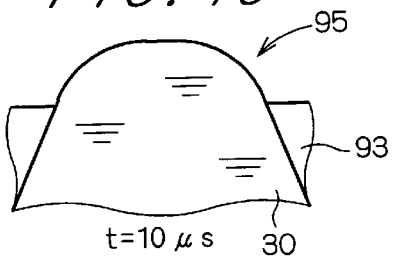

At the point of time when the sound pressure Ps begins to be supplied, as shown in FIG. 7, the meniscus of the ink 30 has a small rise from the opening 95 due to surface tension. By applying the sound pressure Ps, the droplets 31 are jetted from near the rim of the opening 95 until k/f0=0.6 μs. Since the meniscus has a small rise from the opening 95 as shown in FIG. 7, the droplets 31 are jetted radiantly from the opening 95.

With the sound pressure Ps applied, the radiation pressure Pi is applied in a period from t=0 to t=0.6 μs. Considering that the radiation pressure Pi has one-half wavelength of fi=f0/2k, the velocity Vr of the second surface wave is obtained as $fi\cdot(2\pi\sigma/\rho fi^2)^{1/3}$. Assuming that the opening 95 is a circle with a diameter D, a time required for a to-and-fro movement of the second surface wave in the opening 95 is obtained as 2D/Vr. For example, assuming that the surface tension σ of the ink 30 is $5\times10^{-2}$ N/m, the density ρ is $1\times10^3$ kg/m$^3$ and D=50 μm, the required time can be obtained as 2D/Vr=15.6 μs.

Figure 14:
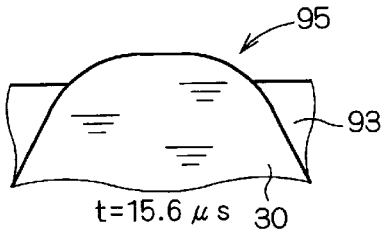

Therefore, as shown in FIGS. 9 to 13, the state of meniscus has a complicate shape until t=15.6 μs due to propagation of the second surface wave, and returns to a state almost like that of t=0, as shown in FIG. 14, when t=15.6 μS. Setting the burst cycle T2 at 2D/Vr, the state of meniscus at the point of time when the jet burst signal 26 is supplied can be kept equally.

There may be a case, naturally, where it is found from an actual measurement that an optimum result can be obtained by setting the burst cycle T2 at a value slightly shifted from the time required for the to-and-fro movement of the second surface wave in the opening 95. It falls within correction of burst cycle of this description, however, to adjust the cycle of variation in level of ink 30 due to the second surface wave and the burst cycle T2 for keeping equally the shape of meniscus at the point of time when the jet burst signal 26 is supplied.

(A-4) Problem caused by Non-Continuous Jet Burst Signal

FIGS. 15A and 15B are waveform views showing a relation between the jet burst signal 26 and meniscus motion of the ink 30 at the dot cycle T3. FIG. 15A shows a timing for supplying the jet burst signal 26 while FIG. 15B shows the center position in the surface of the ink 30 which is exposed in the opening 95. In FIGS. 15A and 15B, horizontally-extended lines are base lines, indicating that the pressure is 0 in the figure on the jet burst signal 26 and the center position of the liquid surface in the state of FIG. 7 in the figure on the position of the liquid surface.

In a period while the jet burst signal 26 is stopped (T3-dj·T2 in FIG. 3), since no radiation pressure Pi is applied, the surface of the ink 30 which is driven with the radiation pressure Pi applied in a period while the jet burst signal 26 is supplied (dj·T2 in FIG. 3) makes free vibration in a mode specific to the opening 95. The free vibration has a wavelength about several times as long as the burst period T2. As discussed in (A-1), when the tone level required of dot is different, dj becomes different and T3-dj·T2 also becomes different, and hence the first jet burst signal 26 in the next dot cycle T3 is not necessarily given to the state of meniscus shown in FIG. 7 or 14.

Therefore, with control over the free vibration specific to the opening 95 which may occur in the period while the jet burst signal 26 is stopped, the surface of the ink 30 is controlled so that the jet burst signal 26 may be given in an appropriate state of meniscus.

B. Preferred Embodiments Using Dummy Burst Signal

(B-1) The First Preferred Embodiment

FIGS. 16A and 16B are waveform views showing a liquid jet driving technique in accordance with the first preferred embodiment of the present invention. FIG. 16A shows a timing for supplying the jet burst signal 26 and a dummy burst signal which is adopted as the suppressing signal 27 while FIG. 16B shows the center position in the surface of the ink 30. The base lines of FIGS. 16A and 16B show the same as those of FIGS. 15A and 15B.

In the present invention, the dummy burst signal refers to a burst signal with which the vibration exciter 9*a* is driven to provide the ink 30 with vibration not sufficient to jet out from the opening 95. The dummy burst signal is generated as a burst signal consisting of a pulse train of a frequency f0, of which pulse number k is smaller than that of the jet burst signal 26. For example, when the jet burst signal 26 has pulses in number k=6, the dummy burst signal has pulses in number k=4. Alternatively, the dummy burst signal is generated as a burst signal having pulses in the same number k and the same frequency f0 as the jet burst signal 26 and a smaller amplitude than the jet burst signal 26.

This dummy burst signal drives the vibration exciter 9*a* in the period while the jet burst signal 26 is not applied in the dot cycle T3, i.e., at a period T3-dj·T2. Therefore, over almost entire dot cycle T3, the jet burst signal 26 or the dummy burst signal is applied to the vibration exciter 9*a* almost at the burst cycle T2.

Since the dummy burst signal does not jet the ink 30 unlike the jet burst signal 26 as discussed above, the tone level of the dot is not deteriorated. Since the dummy burst signal also provide the ink 30 with the radiation pressure, however, it is possible to control the free vibration as shown in FIG. 15B that the ink 30 can make in the period T3-dj·T2 to be almost the same as that in the period dj·T2 while the jet burst signal 26 is applied. Since the dummy burst signal is applied repeatedly at the same cycle as the jet burst signal 26 is applied, especially, the motion of the ink 30 can be kept in an almost stationary state.

The dummy burst signal can be generated easily in the driving circuit 3 shown in FIG. 1. The driving circuit 3 continuously generates dj jet burst signals 26 with respect to the j-th dot on the basis of the information from the jet signal 21. After that, the driving circuit 3 continuously generates the dummy burst signals until the end of the dot cycle T3 to give the signals to the vibration exciter 9*a* as the suppressing signal 27. As discussed earlier, since the dummy burst signal has a frequency f0, the dummy burst signal can be easily generated from the basic signal 28 by using different number k of pulses or different amplitude, like the jet burst signal 26.

In the dot cycle T3, the dummy burst signal does not necessarily have to be supplied after the jet burst signal 26. For example, earlier in the dot cycle T3, some dummy burst signals are supplied to the vibration exciter 9*a*, then the jet burst signals 26 are supplied and thereafter the dummy burst signals are supplied until the end of the dot cycle T3.

(B-2) The Second Preferred Embodiment

FIGS. 17A and 17B are waveform views showing a liquid jet driving technique in accordance with the second preferred embodiment of the present invention. FIG. 17A shows a timing for supplying the jet burst signal 26 and the dummy burst signal while FIG. 17B shows the center position in the surface of the ink 30 which is exposed in the opening 95. The base lines of FIGS. 17A and 17B show the same as those of FIGS. 15A and 15B.

In this preferred embodiment, the dummy burst signal is supplied at a cycle different from the burst cycle T2. Since the wavelength of the free vibration of the ink 30 in a mode specific to the opening 95 can be obtained to be several times as long as the burst cycle T2 through calculation or actual measurement, the dummy burst signal, being adjusted to the wavelength, is supplied for the vibration exciter 9*a*.

In this case, it is desirable to supply the dummy burst signal when the meniscus is displaced closest to the piezoelectric vibrator 92. Supplying the dummy burst signal at this point of time, the piezoelectric vibrator 92 provides the ink 30 with the radiation pressure in a direction from the piezoelectric vibrator 92 to the opening 95, ensuring an easy control of the free vibration. Though there may be a case, naturally, where it is found from an actual measurement that an optimum result can be obtained by supplying the dummy burst signal at a timing slightly shifted from the time when the meniscus is displaced closest to the piezoelectric vibrator 92, it falls within this preferred embodiment to supply the dummy burst signals intermittently in the direction to suppress the free vibration as discussed above.

C. Preferred Embodiments Using Pressure Pulse

In the preferred embodiments of Section B, the dummy burst signal is used to generate the radiation pressure Pi. Instead of using the radiation pressure Pi accompanying the sound pressure Ps, however, a pressure independent of the sound pressure Ps can be used and by applying the pressure to the ink 30, the free vibration in the surface of the ink 30 in the opening 95 can be suppressed.

FIG. 18 is a cross section schematically showing a structure of the ink head 9 additionally provided with a structure to apply that pressure. The body 94 and the vibration exciter 9*a* of FIG. 2 are replaced by a body 97 and a vibration exciter 9*b*, respectively.

The vibration exciter 9*b* comprises a pressure pulse generator 96 as well as the protection sheet 91 and the piezoelectric vibrator 92. The body 97 is opened on a side of the vibration exciter 9*b* more widely than the body 94. The ink 30 is given pressure by the pressure pulse generator 96 as well as the piezoelectric vibrator 92 with the protection sheet 91 interposed.

Since the pressure pulse generator 96 has no need of generating a sound pressure having a frequency f0, the ink 30 may be given a pressure by generating bubbles with a heating device, instead of being given vibration by a piezoelectric device. This pressure may be applied, for example, for the same period as the radiation pressure, i.e., the period T1 while the jet burst signal 26 exists, or may be applied for a shorter period. Further, the pressure does not necessarily have the same magnitude as that of the radiation pressure Pi by the jet burst signal 26. In other words, this is advantageous in designing flexibility which is greater than a case of using the dummy burst signal as the suppressing signal 27.

In the following discussion, a pressure pulse signal is adopted as the suppressing signal 27, and a positive pressure is applied to the ink 30 in a period while the pressure pulse signal is "H". This pressure pulse signal can be generated easily by using a well-known technique in the driving circuit 3 of FIG. 1.

(C-1) The Third Preferred Embodiment

FIGS. 19A to 19C are waveform views showing a liquid jet driving technique in accordance with the third preferred embodiment of the present invention. FIG. 19A shows a timing for supplying the jet burst signal 26, FIG. 19B shows a timing for supplying the pressure pulse signal and FIG. 19C shows the center position in the surface of the ink 30 which is exposed in the opening 95. The base lines of FIGS. 19A and 19B indicate that the pressure is 0 and that of FIG. 19C indicates the center position of the liquid surface in the state of FIG. 7. This pressure pulse signal can be generated easily by using a well-known technique in the driving circuit 3.

This preferred embodiment is regarded as the same as the first preferred embodiment except that the dummy burst signal is replaced by the pressure pulse signal, and therefore this preferred embodiment can produce the same effect as the first preferred embodiment.

(C-2) The Fourth Preferred Embodiment

FIGS. 20A to 20C are waveform views showing a liquid jet driving technique in accordance with the fourth preferred embodiment of the present invention. FIG. 20A shows a timing for supplying the jet burst signal 26, FIG. 20B shows a timing for supplying the pressure pulse signal and FIG. 20C shows the center position in the surface of the ink 30 which is exposed in the opening 95. The base lines of FIGS. 20A to 20C show the same as those of FIGS. 19A to 19C. This pressure pulse signal can be generated easily by using a well-known technique in the driving circuit 3.

This preferred embodiment is regarded as the same as the second preferred embodiment except that the dummy burst signal is replaced by the pressure pulse signal, and therefore this preferred embodiment can produce the same effect as the second preferred embodiment.

(C-3) The Fifth Preferred Embodiment

By additionally providing the pressure pulse generator 96 as shown in FIG. 18, a negative pressure pulse can be also applied to the ink 30. Only at a desired timing, the pressure pulse signal is made "L". This can be achieved in a case of using a heating device as the pressure pulse generator 96, by stopping heating only at a desired timing, as well as the case of using the piezoelectric device. The pressure pulse signal can be generated easily by using a well-known technique in the driving circuit 3.

FIGS. 21A to 21C are waveform views showing a liquid jet driving technique in accordance with the fifth preferred embodiment of the present invention. FIG. 21A shows a timing for supplying the jet burst signal 26, FIG. 21B shows a timing for supplying the pressure pulse signal and FIG. 21C shows the center position in the surface of the ink 30 which is exposed in the opening 95. The base lines of FIGS. 21A to 21C show the same as those of FIGS. 19A to 19C. For convenience, it is shown that the negative pressure pulse signal is supplied at the point of time when the pressure pulse signal becomes "L".

In this preferred embodiment, it is desirable to supply the negative pressure pulse signal when the meniscus is displaced farthest from the piezoelectric vibrator 92. Supplying the negative pressure pulse signal at this point of time, the piezoelectric vibrator 92 provides the ink 30 with a pressure in a direction from the opening 95 to the piezoelectric vibrator 92, ensuring an easy control of the free vibration. Though there may be a case, naturally, where it is found from an actual measurement that an optimum result can be obtained by supplying the negative pressure pulse signal at a timing slightly shifted from the time when the meniscus is displaced farthest from the piezoelectric vibrator 92, it falls within this preferred embodiment to supply the negative pressure pulse signals intermittently in the direction to suppress the free vibration.

Thus, this preferred embodiment can produce the same effect as the fourth preferred embodiment. Since the pressure pulse generator 96 applies a pressure to the ink 30 also when the droplets 31 are jetted on the basis of the jet burst signal 26, the meniscus at that time is likely to have a shape protruding outside from the opening 95 as compared with the state of FIG. 7. Since the meniscus has the same shape when the jet burst signal 26 is supplied in the dot cycles T3, however, it is advantageously possible to avoid different controls of jetting for dots.

Further, the third to fifth preferred embodiments can be also achieved with the ink head 9 having the structure of FIG. 2 by driving the piezoelectric vibrator 92 with the pressure pulse signal, instead of using the ink head 9 having the structure of FIG. 18. Since the piezoelectric vibrator 92, however, is designed to provide the ink 30 with larger vibration with near the frequency f0 in order to effectively generate the sound pressure Ps, there may be a case where the piezoelectric vibrator 92 does not effectively work, for example, when the pressure pulse is applied in the period T1=k/f0. In other words, in the case of applying the pressure pulse, providing the pressure pulse generator 96 additionally to the piezoelectric vibrator 92 driven with the jet burst signal 26 is better for easy designing.

(C-4) The Sixth Preferred Embodiment

The ink head 9 having the structure of FIG. 18 can apply the negative pressure pulse at the same timing as supply of the jet bust signal 26. The pressure pulse signal can be generated easily by using a well-known technique in the driving circuit 3.

FIGS. 22A and 22B are waveform views showing a liquid jet driving technique in accordance with the sixth preferred embodiment of the present invention. FIG. 22A shows a timing for supplying the jet burst signal 26 and FIG. 22B shows a timing for supplying the pressure pulse signal. The base lines of FIGS. 22A and 22B show the same as those of FIGS. 19A and 19B. For convenience, it is shown that the negative pressure pulse signal is applied at the point of time when the pressure pulse signal becomes "L".

This preferred embodiment can dilute the radiation pressure Pi based on supply of the jet bust signal 26 by applying the negative pressure pulse at the same timing and can thereby suppress generation of the second surface wave. Therefore, even without correction of the burst cycle T2 which can be applied to the present invention in (A-3), a considerable effect can be achieved in preventing variation of meniscus.

Figure 23:
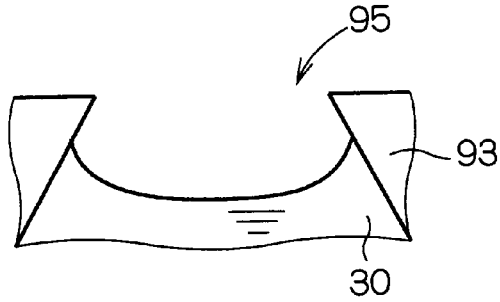
FIGS. 23 to 31 are cross sections showing a liquid jet driving technique in accordance with a seventh preferred embodiment of the present invention.

D. Preferred Embodiments Using Hydrostatic Pressure (D-1) The Seventh Preferred Embodiment FIG. 23 is a cross section schematically showing the state of meniscus of the ink 30 in a waiting state of the ink head. The "waiting state of the ink head" refers to a stationary state where only atmospheric pressure is applied to the ink 30 for a long time. In the waiting state of the ink head, the ink 30 is retreated towards the piezoelectric vibrator 92 while keeping wetting against the inner wall of the nozzle plate 93 with surface tension, and the meniscus is out of contact with the rim of the opening 95.

Figure 24:
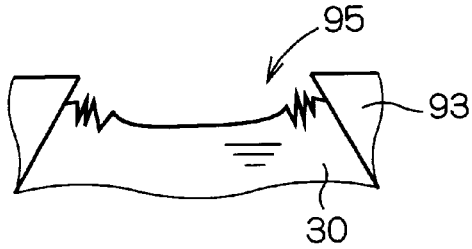
Figure 25:
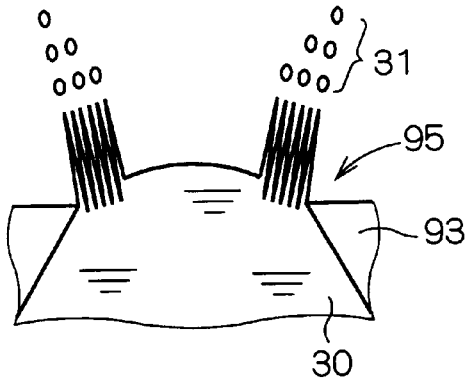

FIG. 24 is a cross section schematically showing the state of meniscus of the ink 30 when the jet burst signal 26 is applied to the piezoelectric vibrator 92 immediately after the waiting state of the ink 30. Since the liquid surface is out of contact with the rim of the opening 95 serving as a fixed end in the state immediately before the ink is vibrated, the first surface wave becomes hard to create and it becomes difficult to jet the droplets 31. When the jet burst signal 26 is supplied for the piezoelectric vibrator 92 several times, the surface level of the ink 30 gradually rises and the ink 30 reaches the rim of the opening 95 to appropriately jet the droplets 31.

In consideration of this phenomenon, at least when the jet burst signal 26 is applied from the waiting state of the ink head, it is desirable to provide the ink 30 with hydrostatic pressure, which overwhelms the surface tension to push the liquid level up. On the other hand, once the liquid level of the ink 30 rises, it takes considerable time to reach a stationary state because at least one jet burst signal 26, dummy burst signal or pressure pulse signal is applied to the vibration exciters 9*a* and 9*b* every dot cycle T3.

Figure 26:
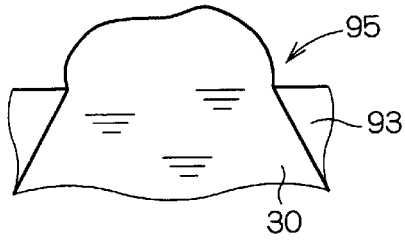
Figure 27:
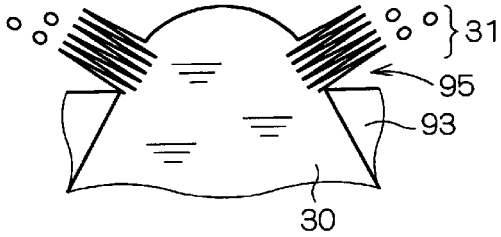
Figure 28:
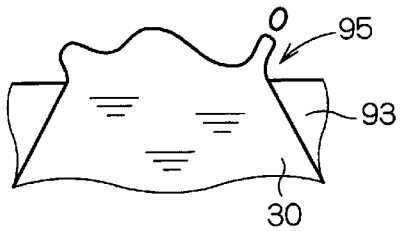

FIG. 26 is a cross section schematically showing the state of meniscus of the ink 30 after the jet burst signal 26 is supplied for the piezoelectric vibrator 92 several times, where the hydrostatic pressure continues to be applied. As shown in this figure, when the hydrostatic pressure continues to be applied to the liquid surface which once reaches the rim of the opening 95, the shape of the liquid surface is deformed. FIG. 27 is a cross section schematically showing the state of meniscus of the ink 30 when the jet burst signal 26 is supplied for the piezoelectric vibrator 92 in the state of FIG. 26. In a state immediately before the ink 30 is vibrated, since the liquid level greatly rises from the opening 95 or the liquid spills over, it becomes difficult in some cases to control jetting of the droplets 31. Further, in some cases, a large droplet is discharged from the liquid surface of the ink 30, to deteriorate the tone of dot.

Therefore, when the jet burst signal 26 is supplied from the waiting state of the ink head, it is desirable to provide the ink 30 with the hydrostatic pressure, to push the liquid level of the ink 30 up to the rim of the opening 95, and to reduce the hydrostatic pressure or provide a negative hydrostatic pressure after the jet burst signal 26 is supplied for the piezoelectric vibrator 92.

Figure 29:
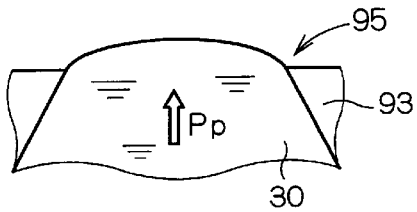
Figure 30:
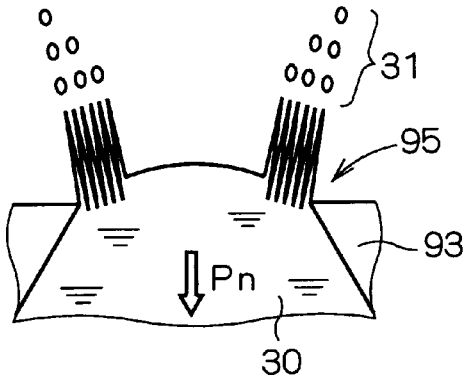
Figure 31:
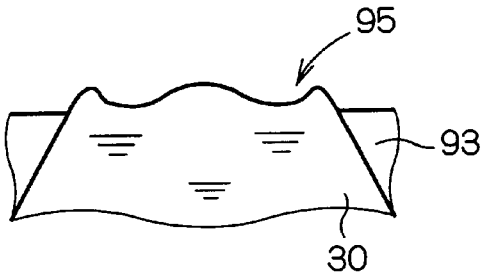

FIG. 29 is a cross section schematically showing the state where a positive hydrostatic pressure Pp is applied in the waiting state of the ink head. Thus, by applying the positive hydrostatic pressure Pp, the liquid surface of the ink 30 reaches the rim of the opening 95. FIG. 30 is a cross section schematically showing the state where the jet burst signal 26 is supplied for the piezoelectric vibrator 92 and a negative hydrostatic pressure Pn is applied. As discussed above, instead of applying the negative hydrostatic pressure, there may be a case where the positive hydrostatic pressure Pp is reduced to the degree smaller than that in the waiting state of the ink head. That makes the meniscus stable and avoids jet failure of the droplet 31 and discharge of large droplet.

Figure 32:
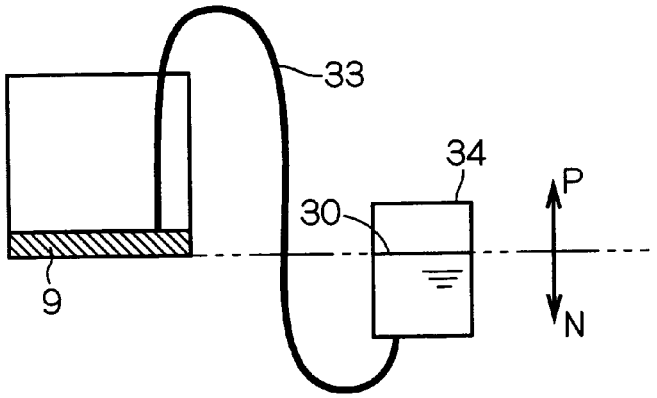
FIG. 32 is a cross section schematically showing an exemplary structure in accordance with the seventh preferred embodiment of the present invention.

FIG. 32 is a cross section schematically showing an exemplary structure to achieve this preferred embodiment. The ink 30 is supplied from an ink tank 34 through an ink supply tube 33 to the inside of the ink head 9. Applying the positive hydrostatic pressure Pp as shown in FIG. 29 is achieved by moving the ink tank 34 in the upward direction P and applying the negative hydrostatic pressure Pn or reducing the positive hydrostatic pressure Pp as shown in FIG. 30 is achieved by moving the ink tank 34 in a downward direction N. The moving operation of the ink tank 34 is achieved by using a well-known technique.

(D-2) The Eighth Preferred Embodiment

The seventh preferred embodiment proposes a control to avoid the state where the meniscus of the ink 30 is out of contact with the rim of the opening 95 while preventing the ink 30 from spilling over from the opening 95. It is possible, however, to control the hydrostatic pressure while keeping the liquid surface of the ink 30 in contact with the rim of the opening 95 also in the state where the ink head is driven at the dot cycle T3, instead of the waiting state of the ink head.

Figure 33:
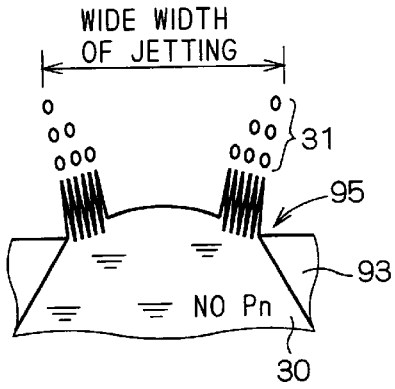
FIGS. 33 to 35 are cross sections showing a liquid jet driving technique in accordance with an eighth preferred embodiment of the present invention.
Figure 34:
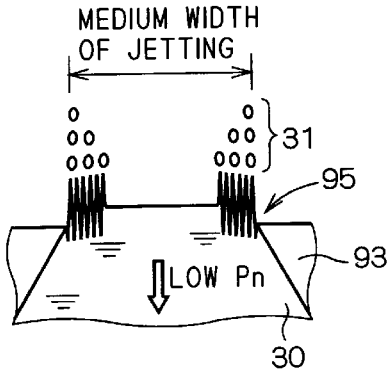
Figure 35:
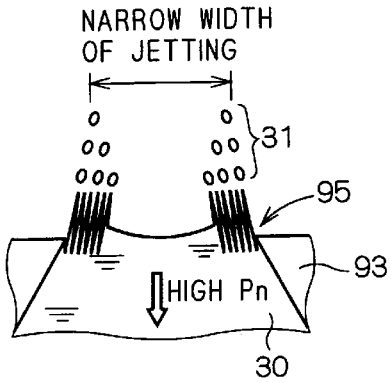

FIGS. 33 to 35 are cross sections schematically showing the state of meniscus of the ink 30 in the period while the jet burst signal 26 is supplied for the piezoelectric vibrator 92. The negative hydrostatic pressure Pn is higher in FIG. 34 than in FIG. 33, and higher in FIG. 35 than in FIG. 34. As the negative hydrostatic pressure Pn becomes higher, the liquid surface of the ink 30 moves in a direction from the opening 95 towards the piezoelectric vibrator 92. Since the first surface wave is created when the liquid surface of the ink 30 is in contact with the rim of the opening 95, the more converged droplets 31 can be jetted as the negative hydrostatic pressure becomes higher, and narrowing the width of jetting, the droplets 31 responding to more delicate image can be jetted.

The control of the shape of the meniscus shown in FIGS. 33 to 35 is achieved by controlling the ratio of the burst cycle T2 to the period k·T0 for supplying the jet burst signal 26 to change the length of period to apply the radiation pressure Pi to the ink 30. Specifically, if the period k·T0 for supplying the jet burst signal 26 is fixed, the burst cycle T2 is made longer to retreat the shape of meniscus towards the piezoelectric vibrator 92 and that makes the width of jetting narrower. Further, in order to keep the shape of meniscus stable, it is desirable to supply the piezoelectric vibrator 92 with the dummy burst signal and the pressure pulse signal as discussed in the first and third preferred embodiments.

E. Preferred Embodiments Using Second Surface Wave

(E-1) The Ninth Preferred Embodiment

As discussed earlier, the piezoelectric vibrator 92 supplied with the jet burst signal 26 provides the ink 30 with the radiation pressure Pi as well as the sound pressure Ps. Therefore, adjusting the timing of applying the radiation pressure Pi, i.e., the burst cycle T2 to the cycle of free vibration specific to the opening 95 allows great displacement of the meniscus.

Figure 36:
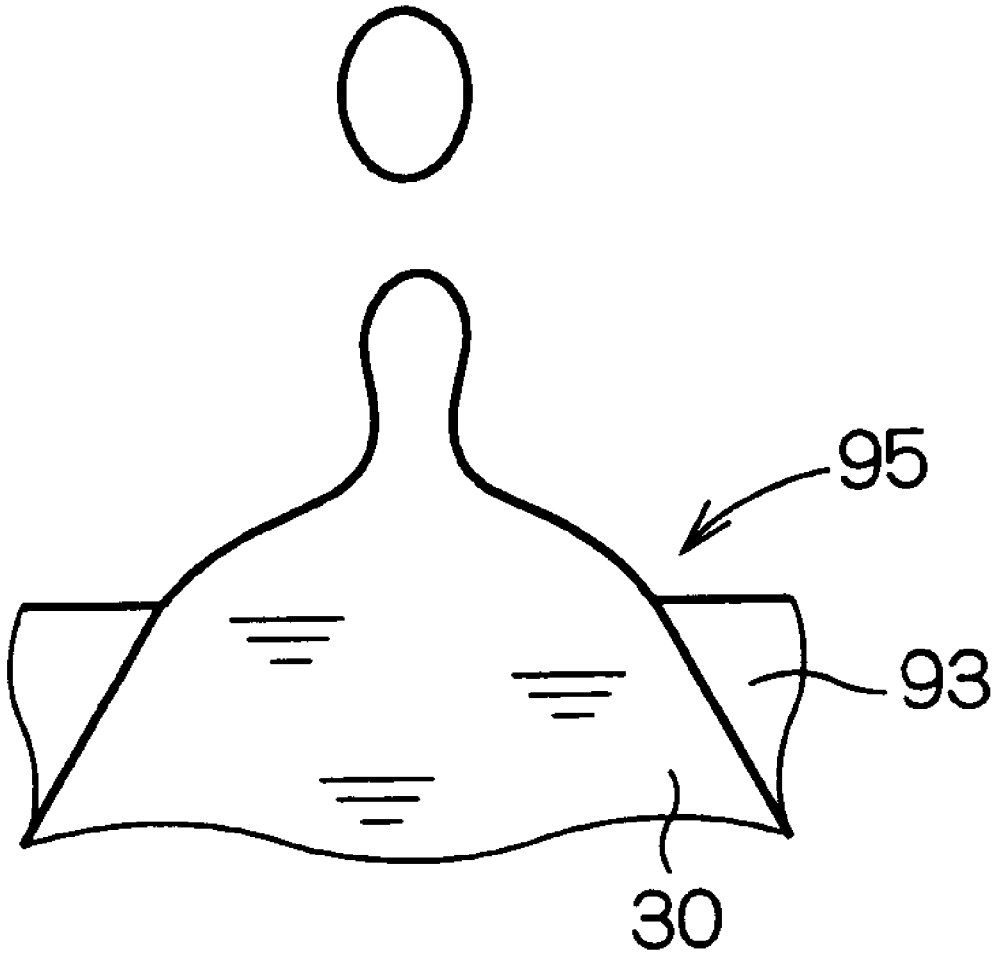
FIG. 36 is a cross section showing a liquid jet driving technique in accordance with a ninth preferred embodiment of the present invention.

FIG. 36 is a cross section schematically showing the motion of the meniscus in accordance with this preferred embodiment. Although the second surface wave is created from the rim of the opening 95 by the radiation pressure Pi, since the jet burst signal 26 is supplied at the cycle of the free vibration specific to the opening 95, the meniscus is greatly displaced to jet the large droplets 31.

Thus, in this preferred embodiment, by controlling the burst cycle T2, the small droplets 31 are jetted from the first surface wave, as shown in the first preferred embodiment, to obtain an excellent graininess when the image data has a great number of tone levels, and the large droplets 31 are jetted from the second surface wave to obtain a sharp image when the image data has a small number of tone levels (e.g., binary image such as character information). Depending on whether the number of tone levels is large or small, the suitable droplets 31 can be deposited on printed paper.

In this preferred embodiment, like the eighth preferred embodiment, in order to keep the shape of meniscus stable, it is desirable to supply the piezoelectric vibrator 92 with the dummy burst signal as discussed in the first preferred embodiment and the pressure pulse signal as discussed in the third preferred embodiment.

Though there may be a case, naturally, where it is found from an actual measurement that an optimum result can be obtained when there is a slight difference between the burst cycle T2 and the cycle of free vibration specific to the opening 95, it falls within this preferred embodiment to control the burst cycle T2 to excite the above free vibration by utilizing resonance.

While the invention has been shown and described in detail, the foregoing description is in all aspects illustrative and not restrictive. It is therefore understood that numerous modifications and variations can be devised without departing from the scope of the invention.

What is claimed is:

1. A liquid jet driving device, comprising:

a liquid jet unit having a jet surface provided with an opening to limitedly expose a surface of a liquid to be jetted out and a vibration exciter provided on an opposite side to said jet surface with said liquid interposed therebetween for providing said liquid with vibration; and a driving unit configured to provide said vibration exciter with a suppressing signal and a jet burst signal which includes a pulse train of a first frequency to drive said vibration exciter, wherein vibration provided for said liquid by said vibration exciter which is driven with said jet burst signal jets said liquid from said jet surface and vibration provided for said liquid by said vibration exciter which is driven with said suppressing signal suppresses free vibrations on the surface of said liquid without jetting said liquid from said jet surface.

2. The liquid jet driving device according to claim 1, wherein said suppressing signal is a suppressing burst signal consisting of a pulse train of said first frequency and has less pulses in number than said jet burst signal.

3. The liquid jet driving device according to claim 1, wherein said suppressing signal is a suppressing burst signal consisting of a pulse train of said first frequency which has a smaller amplitude than those of said jet burst signal.

4. The liquid jet driving device according to claim 1, wherein said vibration exciter is driven with said jet burst signal to provide said liquid with a first radiation pressure, said liquid makes free vibration caused by said first radiation pressure in a mode specific to the shape of said opening, said suppressing signal is supplied for said vibration exciter near at least one timing when said free vibration takes an amplitude of extreme value, and said vibration exciter is driven with said suppressing signal to provide said liquid with a second radiation pressure which works in a direction to suppress said free vibration.

5. The liquid jet driving device according to claim 1, wherein said vibration exciter has a first vibration exciter supplied with said jet burst signal and a second vibration exciter supplied with said suppressing signal.

6. The liquid jet driving device according to claim 5, wherein said first vibration exciter is driven with said jet burst signal to provide said liquid with a radiation pressure, said liquid makes free vibration caused by said radiation pressure in a mode specific to the shape and size of said opening, said suppressing signal is supplied for said second vibration exciter near at least one timing when said free vibration takes an amplitude of extreme value, and said second vibration exciter is driven with said suppressing signal to provide said liquid with a pressure which works in a direction to suppress said free vibration.

7. The liquid jet driving device according to claim 6, wherein said suppressing signal is supplied for said vibration exciter at the point of time when a liquid level of said liquid in said opening takes an extreme value near the side of said vibration exciter in said free vibration.

8. The liquid jet driving device according to claim 5, wherein said second vibration exciter is driven with said suppressing signal in a period while said jet burst signal is supplied for said first vibration exciter, to provide said liquid with a pressure having a direction opposite to that of a radiation pressure provided for said liquid by said first vibration exciter driven with said jet burst signal.

9. The liquid jet driving device according to claim 1, wherein said jet burst signal and said suppressing signal are supplied for said vibration exciter repeatedly with a second frequency.

10. The liquid jet driving device according to claim 9, wherein said second frequency is a frequency with which said liquid makes free vibration in a mode specific to the shape of said opening.

11. The liquid jet driving device according to claim 1, wherein said jet burst signal is supplied for said vibration exciter repeatedly during a period required for a to-and-fro movement of a surface wave in the opening, which is excited on the basis of a radiation pressure to push said liquid out from said opening in a period while said vibration exciter is driven.

12. A liquid jet driving device, comprising:

a liquid jet unit having a jet surface provided with an opening to limitedly expose a surface of a liquid to be jetted out and a vibration exciter provided on an opposite side to said jet surface with said liquid interposed therebetween configured to provide said liquid with vibration;

a driving unit configured to provide said vibration exciter with a jet burst signal which includes a pulse train of a predetermined frequency to drive said vibration exciter; and a hydrostatic pressure applying mechanism configured to apply a controllable hydrostatic pressure to said liquid.

13. The liquid jet driving device according to claim 12, wherein said hydrostatic pressure applying mechanism applies a positive hydrostatic pressure to said liquid in a waiting state where said liquid is in a stationary state, as said jet burst signal is not supplied, and reducing said positive hydrostatic pressure or applying a negative hydrostatic pressure after said jet burst signal is supplied.

14. A method of driving a liquid jet, comprising the steps of:

supplying a jet burst signal which includes a pulse train of a first frequency to provide a liquid with a vibration to jet said liquid from a jet surface; and supplying a suppressing signal to provide said liquid with a vibration to suppress free vibrations on the jet surface of said liquid without jetting said liquid from said jet surface.

15. The method of driving a liquid jet according to claim 14, wherein said jet surface is provided with an opening in a liquid jet unit to limitedly expose a surface of said liquid, said step of supplying said jet burst signal comprises a step of supplying said jet burst signal to a vibration exciter provided on an opposite side to said jet surface with said liquid interposed therebetween, and said step of supplying said suppressing signal comprises the step of supplying said suppressing signal to said vibration exciter.

16. The method of driving a liquid jet according to claim 15, wherein said step of supplying a suppressing signal comprises a step of supplying said suppressing burst signal including a pulse train of said first frequency.

17. The method of driving a liquid jet according to claim 15, wherein said step of supplying said suppressing signal comprises a step of supplying a pulse to said vibration exciter configured to provide said liquid with a pressure.

18. The method of driving a liquid jet according to claim 15, wherein said step of supplying said suppressing signal comprises a step of supplying repeatedly to said vibration exciter a second frequency signal together with said jet burst signal.

19. The method of driving a liquid jet according to claim 15, wherein said step of supplying said suppressing signal comprises a step of supplying, against free vibration in a mode specific to the shape of said opening, which is made by said liquid on the basis of a radiation pressure to push said liquid out from said opening in a period while said jet burst signal is supplied, said suppressing signal configured to drive said vibration exciter in a direction to suppress said free vibration near at least one timing when said free vibration takes an amplitude of extreme value.

20. The method of driving a liquid jet according to claim 15, wherein said step of supplying said suppressing signal comprises a step of supplying said suppressing signal to said vibration exciter in a period while said jet burst signal is supplied, suppressing signal provides said liquid with a pressure having a direction opposite to that of a radiation pressure which pushes said liquid out from said opening in a period while said jet burst signal is supplied.

* * * * *